US009512702B2

(12) United States Patent
Greene et al.

(10) Patent No.: US 9,512,702 B2
(45) Date of Patent: Dec. 6, 2016

(54) SAND CONTROL SYSTEM AND METHODOLOGY

(71) Applicant: SCHLUMBER TECHNOLOGY CORPORATION, Sugar Land, TX (US)

(72) Inventors: Robin M. Greene, Stavanger (NO); Terje Moen, Sandnes (NO)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 14/448,254

(22) Filed: Jul. 31, 2014

(65) Prior Publication Data

US 2015/0034323 A1 Feb. 5, 2015

Related U.S. Application Data

(60) Provisional application No. 61/860,807, filed on Jul. 31, 2013, provisional application No. 61/893,677, filed on Oct. 21, 2013.

(51) Int. Cl.
*E21B 43/12* (2006.01)

(52) U.S. Cl.
CPC ..... *E21B 43/12* (2013.01)

(58) Field of Classification Search
CPC ..... E21B 43/12; E21B 21/08; E21B 43/14; E21B 34/08; E21B 21/00
See application file for complete search history.

(56) References Cited

U.S. PATENT DOCUMENTS

| | | | | |
|---|---|---|---|---|
| 5,174,330 | A | 12/1992 | Golestan et al. | |
| 5,265,643 | A | 11/1993 | Golestan et al. | |
| 5,383,489 | A | 1/1995 | Golestan et al. | |
| 5,529,090 | A | 6/1996 | Golestan et al. | |
| 6,394,181 | B2 * | 5/2002 | Schnatzmeyer | E21B 43/12 166/250.15 |
| 6,786,285 | B2 | 9/2004 | Johnson et al. | |
| 7,789,145 | B2 | 9/2010 | Patel | |
| 7,819,196 | B2 | 10/2010 | Aakre et al. | |
| 7,870,906 | B2 | 1/2011 | Ali | |

(Continued)

FOREIGN PATENT DOCUMENTS

| | | | |
|---|---|---|---|
| WO | 2009123464 | A1 | 10/2009 |
| WO | 2011099888 | A1 | 8/2011 |

(Continued)

*Primary Examiner* — Zakiya W Bates
(74) *Attorney, Agent, or Firm* — Jeffrey R. Peterson

(57) ABSTRACT

A technique facilitates a more desirable inflow distribution of fluid along a tubing string deployed in a wellbore. The technique comprises providing a tubing string with a plurality of flow control devices and conveying the tubing string downhole into the wellbore. An injection fluid is pumped down along an interior of the tubing string and out through the plurality of flow control devices for entry into the surrounding formation. Based on a function of this injection flow, the flow areas of the flow control devices are adjusted to improve the subsequent distribution of inflowing fluids. The injection and the subsequent adjustment of flow areas as a function of the injection flow through each flow control device may be repeated for continued improvement, e.g. continued optimization, of the inflow distribution.

23 Claims, 10 Drawing Sheets

(56) References Cited

U.S. PATENT DOCUMENTS

| | | | | |
|---|---|---|---|---|
| 7,909,088 | B2 | 3/2011 | O'Malley et al. | |
| 8,235,128 | B2 | 8/2012 | Dykstra et al. | |
| 8,291,976 | B2 | 10/2012 | Schultz et al. | |
| 8,327,885 | B2 | 12/2012 | Dykstra et al. | |
| 8,403,038 | B2 | 3/2013 | Russell et al. | |
| 8,443,901 | B2 | 5/2013 | Moen et al. | |
| 8,479,831 | B2 | 7/2013 | Dykstra et al. | |
| 8,485,258 | B2 | 7/2013 | Mathiesen et al. | |
| 8,517,099 | B2 | 8/2013 | Mathiesen et al. | |
| 8,534,355 | B2 | 9/2013 | Johannesen et al. | |
| 8,590,630 | B2 | 11/2013 | Mathiesen et al. | |
| 8,607,873 | B2 | 12/2013 | Aadnoy et al. | |
| 8,616,290 | B2 | 12/2013 | Dykstra et al. | |
| 8,622,136 | B2 | 1/2014 | Dykstra et al. | |
| 8,646,535 | B2 | 2/2014 | Xu et al. | |
| 8,657,015 | B2 | 2/2014 | Patel et al. | |
| 8,657,017 | B2 | 2/2014 | Dykstra et al. | |
| 8,700,371 | B2 | 4/2014 | Thambynayagam et al. | |
| 8,708,050 | B2 | 4/2014 | Dykstra et al. | |
| 8,714,266 | B2 | 5/2014 | Dykstra et al. | |
| 8,714,936 | B2 | 5/2014 | Valsecchi et al. | |
| 8,752,629 | B2 | 6/2014 | Moen | |
| 8,794,329 | B2 | 8/2014 | Holderman et al. | |
| 8,820,413 | B2 | 9/2014 | Mathiesen et al. | |
| 8,820,414 | B2 | 9/2014 | Mathiesen et al. | |
| 8,833,445 | B2 | 9/2014 | Techentien et al. | |
| 8,851,180 | B2 | 10/2014 | Dykstra et al. | |
| 8,875,797 | B2 | 11/2014 | Aakre et al. | |
| 8,925,633 | B2 | 1/2015 | Nguyen et al. | |
| 8,931,566 | B2 | 1/2015 | Dykstra et al. | |
| 8,936,094 | B2 | 1/2015 | Least et al. | |
| 2006/0266420 | A1* | 11/2006 | Lonnes | F16K 3/265 137/496 |
| 2008/0041581 | A1 | 2/2008 | Richards et al. | |
| 2009/0218103 | A1 | 9/2009 | Aakre et al. | |
| 2009/0294123 | A1* | 12/2009 | Mescall | E21B 34/063 166/250.01 |
| 2010/0108313 | A1* | 5/2010 | Chan | E21B 43/12 166/263 |
| 2011/0042092 | A1 | 2/2011 | Fripp et al. | |
| 2011/0056700 | A1 | 3/2011 | Mathiesen et al. | |
| 2011/0186300 | A1 | 8/2011 | Dykstra et al. | |
| 2011/0198097 | A1 | 8/2011 | Moen | |
| 2011/0290326 | A1 | 12/2011 | Ovland et al. | |
| 2012/0211243 | A1 | 8/2012 | Dykstra et al. | |
| 2012/0255740 | A1 | 10/2012 | Fripp et al. | |
| 2013/0000883 | A1 | 1/2013 | Aakre et al. | |
| 2013/0008513 | A1 | 1/2013 | Aakre et al. | |
| 2013/0075107 | A1 | 3/2013 | Dykstra et al. | |
| 2013/0092393 | A1 | 4/2013 | Dykstra et al. | |
| 2013/0140038 | A1 | 6/2013 | Fripp et al. | |
| 2013/0180727 | A1 | 7/2013 | Dykstra et al. | |
| 2013/0192833 | A1 | 8/2013 | Gano et al. | |
| 2013/0206245 | A1 | 8/2013 | Clark et al. | |
| 2013/0248178 | A1 | 9/2013 | Hecker et al. | |
| 2013/0255960 | A1 | 10/2013 | Fripp et al. | |
| 2013/0264072 | A1* | 10/2013 | Lopez | E21B 43/08 166/386 |
| 2013/0277043 | A1 | 10/2013 | Hallundbaek et al. | |
| 2013/0277066 | A1 | 10/2013 | Fripp et al. | |
| 2013/0319664 | A1 | 12/2013 | McNamee et al. | |
| 2014/0000869 | A1 | 1/2014 | Holderman et al. | |
| 2014/0008079 | A1 | 1/2014 | Werswick et al. | |
| 2014/0027126 | A1 | 1/2014 | Aakre et al. | |
| 2014/0034324 | A1 | 2/2014 | Lopez et al. | |
| 2014/0041731 | A1 | 2/2014 | Fripp et al. | |
| 2014/0048282 | A1 | 2/2014 | Dykstra et al. | |
| 2014/0060846 | A1 | 3/2014 | Hallundbaek et al. | |
| 2014/0083682 | A1* | 3/2014 | Grigsby | E21B 43/04 166/250.01 |
| 2014/0151052 | A1 | 6/2014 | Themig et al. | |
| 2014/0174750 | A1 | 6/2014 | Fripp et al. | |
| 2014/0198617 | A1 | 7/2014 | Noui-Mehidi et al. | |
| 2014/0209822 | A1 | 7/2014 | Mathiesen et al. | |
| 2014/0216733 | A1 | 8/2014 | Mathiesen et al. | |
| 2014/0224471 | A1 | 8/2014 | Coon et al. | |
| 2014/0246205 | A1 | 9/2014 | Noui-Mehidi et al. | |
| 2014/0251609 | A1 | 9/2014 | Broussard et al. | |
| 2014/0251613 | A1 | 9/2014 | Hill et al. | |
| 2014/0262235 | A1 | 9/2014 | Rashid et al. | |
| 2014/0262260 | A1 | 9/2014 | Mayer et al. | |
| 2014/0262322 | A1 | 9/2014 | Yeh et al. | |
| 2014/0284060 | A1 | 9/2014 | Ward et al. | |
| 2014/0305630 | A1 | 10/2014 | Kang et al. | |
| 2014/0311747 | A1 | 10/2014 | Aitken et al. | |
| 2014/0332229 | A1 | 11/2014 | Greci et al. | |
| 2014/0332234 | A1 | 11/2014 | Hallundbaek et al. | |
| 2014/0338899 | A1 | 11/2014 | Entchev et al. | |
| 2014/0352942 | A1 | 12/2014 | Hallunbaek et al. | |
| 2015/0013978 | A1 | 1/2015 | Nenniger et al. | |
| 2015/0021015 | A1 | 1/2015 | Xiao et al. | |
| 2015/0021019 | A1 | 1/2015 | Veit et al. | |
| 2015/0027715 | A1 | 1/2015 | Tinnen et al. | |
| 2015/0034334 | A1 | 2/2015 | Hallundbaek et al. | |
| 2015/0040990 | A1 | 2/2015 | Mathiesen et al. | |
| 2015/0041146 | A1 | 2/2015 | Fripp et al. | |
| 2015/0053417 | A1 | 2/2015 | Holderman et al. | |
| 2015/0053419 | A1 | 2/2015 | Garcia et al. | |
| 2015/0060084 | A1 | 3/2015 | Moen et al. | |
| 2015/0218909 | A1* | 8/2015 | Yeh | E21B 43/045 166/305.1 |

FOREIGN PATENT DOCUMENTS

| | | | |
|---|---|---|---|
| WO | 2012081986 | A1 | 6/2012 |
| WO | 2013122500 | A1 | 8/2013 |

* cited by examiner

SAND CONTROL SYSTEM AND METHODOLOGY

CROSS-REFERENCE TO RELATED APPLICATIONS

The present document is based on and claims priority to U.S. Provisional Application Ser. No. 61/860,807 filed Jul. 31, 2013, and to U.S. Provisional Application Ser. No. 61/893,677 filed Oct. 21, 2013, both of which are incorporated herein by reference.

BACKGROUND

Hydrocarbon fluids such as oil and natural gas are obtained from a subterranean geologic formation, referred to as a reservoir, by drilling a well that penetrates the hydrocarbon-bearing formation. Once a wellbore is drilled, various forms of well completion components, including production tubing, may be installed in the well. In certain applications, inflow control devices are employed to create flow restrictions for fluids flowing from the annulus into the production tubing. The inflow control devices are used to distribute a production inflow over the length of the tubing string. However, differences in the permeability of formation zones surrounding the wellbore and/or changes in the permeability of the formation zones over time can reduce the efficiency of production and well fluid recovery.

SUMMARY

In general, a system and methodology are provided for facilitating a more desirable inflow distribution of fluid along a tubing string deployed in a wellbore. The system and methodology comprise providing a tubing string with a plurality of flow control devices and conveying the tubing string downhole into the wellbore. An injection fluid is pumped down along an interior of the tubing string and out through the plurality of flow control devices for entry into the surrounding formation. Based on a function of this injection flow, the flow areas of the flow control devices are adjusted to improve the subsequent distribution of inflowing fluids. For example, the flow areas of the flow control devices may be adjusted so as to provide an improved inflow of production fluids as production fluids are produced from the surrounding formation zones. The injection and the consequent adjustment of flow areas as a function of the injection flow through each flow control device may be repeated for continued improvement, e.g. continued optimization, of the inflow distribution.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
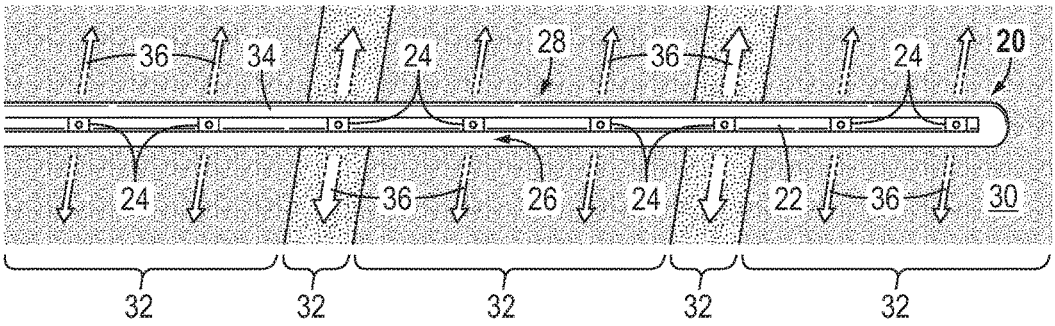
FIG. 1 is a schematic illustration of an example of a well system deployed in a wellbore extending through a formation having a plurality of well zones with different levels of permeability, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a system and methodology which facilitate a more desirable inflow distribution of fluid along a tubing string deployed in a wellbore. The system and methodology comprise providing a tubing string with a plurality of flow control devices and conveying the tubing string downhole into the wellbore. The flow control devices are adjusted to provide inflows of production fluid according to parameters of the surrounding formation, e.g. permeability of well zones in the surrounding formation. The flow control devices are adjusted as a function of an injection fluid flow initiated prior to inflow of the production fluid.

For example, an injection fluid may be pumped down along an interior of the tubing string and out through the plurality of flow control devices for entry into the surrounding formation. Based on a function of the injection flow rates into the different well zones, the flow areas of the flow control devices are adjusted to improve the subsequent distribution of inflowing fluids. The injection and the consequent adjustment of flow areas as a function of the injection flow through each flow control device may be repeated for continued improvement, e.g. continued optimization, of the inflow distribution. Although described with respect to optimizing inflow of production fluids, the technique also may be used to facilitate other procedures, e.g. well cleanup procedures.

In a hydrocarbon well, a sand control system may be used to control or restrict the flow of fluid into a production tubing string by using a plurality of flow control devices, such as inflow control devices (ICDs). The ICDs work by creating flow restrictions through the production tubing such that inflow of production fluid into the tubing tends to be more distributed over the length of the production tubing string. The restrictions avoid concentrated flow in highly permeable zones of the formation or at the top of the production tubing. Adjustable flow control devices, e.g. adjustable ICDs, may be used to variably control or restrict the inflow of fluid into the production tubing string at different well zones.

Embodiments described herein disclose a flow control system and method that adjusts the flow of fluid through one or more flow control devices on a tubing string deployed and fixed in a wellbore. The flow control devices may be set to adjust the flow restriction so as to control the inflow of fluid into a production tubing string from different well zones of the surrounding formation during, for example, a production operation. The flow control devices are adjustable to multiple flow restriction positions after being deployed in the well. For example, the flow control devices may be set at various injection and production flow control settings which are dependent upon characteristics of the wellbore/formation in which the tubing string is deployed and fixed.

As described in greater detail below, an injection operation or injection test may initially be performed by pumping fluid through the flow control devices, into the surrounding wellbore annulus, and out into the well zones of the surrounding formation. During the injection operation, the flow control devices may be activated or armed so that each flow control device is transitioned into a selected flow restriction position after occurrence of a triggering event. The selected flow restriction position of each flow control device may be dependent upon and determined by the differential pressure across the flow control device or across one or more components of the overall flow control device assembly. For example, the differential pressure may be measured across a flow restriction or ICD nozzle where the choke of the ICD nozzle is adjustable. The flow rate of injection fluid through the flow control device may be dependent upon or a function of the permeability of the well zones of the surrounding formation. Based on the flow rates of the injection fluid at each of the flow control devices, the flow control devices are individually triggered and transitioned to a selected flow restriction position for use during a production operation. The production flow restriction positions are a function of the injection flow areas and are selected to control the inflow of fluid from the wellbore annulus, through the flow control devices, and into the tubing string.

The injection test/process enables determination of improved flow control device settings which may be set at the individual flow control devices after completion of the well. In other embodiments, the injection test/process may be used to select flow control device settings for improving a well cleanup operation. In some applications, repeated use of the injection process to optimize flow control device settings can be used to improve the cleanup operation. Additionally, the process of cycling injection and production can be used repeatedly throughout the lifetime of the well to continually improve, e.g. optimize, flow control device settings during each stage of the life of the well. Using the injectivity process for setting flow areas of the flow control devices also can help compensate for heel-toe effect, reservoir heterogeneity, and water/gas coning phenomena.

A flow control system and method as described herein may be implemented firstly as a completions tool installation followed by an injection pumping operation. As illustrated in the example of FIG. 1, a flow control system 20 may comprise a tubing string 22, e.g. a production string, having a plurality of flow control devices 24, e.g. ICDs. In this example, the tubing string 22 is deployed downhole and fixed in a wellbore 26 of a well 28. The wellbore 26 may be drilled into a surrounding formation 30 having a plurality of well zones 32 with varying characteristics, e.g. varying permeability. Each flow control device 24 controls flow of fluid into the tubing string 22.

Depending on the application, the flow control system 20 may comprise a variety of other components. For example, the flow control system 20 may comprise filter media for filtering sand and other particles from a wellbore annulus 34 as the well fluid flows from the well zones 32, through the flow control devices 24, and into an interior of the tubing string 22. By way of example, each flow control device may comprise one or more flow control features which may be in the form of ICD nozzles, flow restrictions, tortuous flow paths, turbulent flow paths, and/or other flow control features. Each flow control device also may comprise valves, e.g. ICD valves, that may be set at variable choke positions. In some applications, the valves or other flow control features may be set to a closed position where the inflow of fluid through the flow control device is substantially blocked.

In some embodiments, a combined filter media, flow control device, e.g. ICD assembly, and a joint of production tubing may be referred to as a screen assembly. During installation of flow control system 20 downhole, the individual flow control devices 24 sometimes are set to individual settings prior to installation. The flow control system 20 is constructed to operate as a production string, however short intervals of fluid injection into the well zones 32, as represented by arrows 36, are used to set flow areas, e.g. choke settings, for the individual flow control devices 24. The injected fluid 36 may comprise a variety of fluids, such as water, production fluid, diesel, or other suitable injection fluids. The flow control devices 24 may be constructed to enable selective choke settings in both the injection flow direction and the production flow direction.

During the injection stage, for example, the injection flow choke of each flow control device 24 may be set at a constant choke setting where the pressure across the choke is dependent on the flow across the choke (typically $\alpha\rho v^2$). The production flow choke of each flow control device 24 may be a variable choke or a combination of chokes that enable selecting the production choke setting (flow area) according to the magnitude of the injection choke pressure differential.

Figure 2:
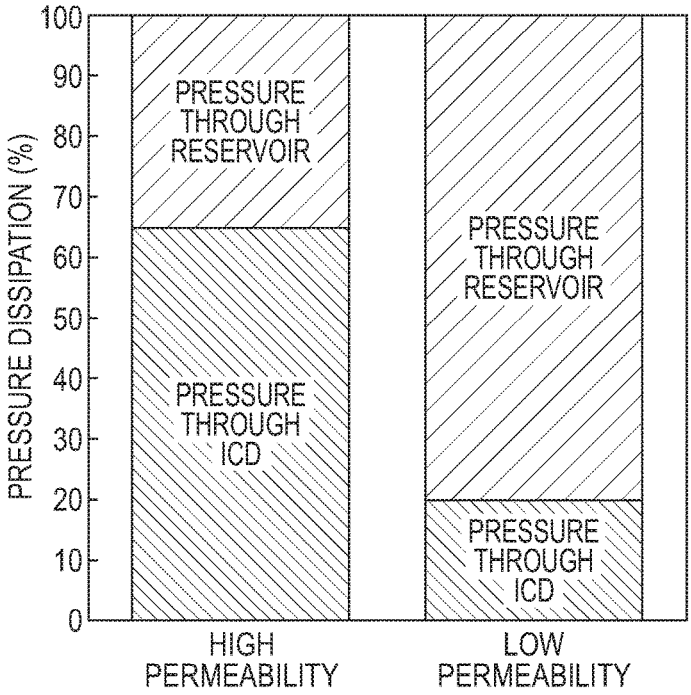
FIG. 2 is a graphical representation of pressure dissipation in a high permeability well zone and a low permeability well zone, according to an embodiment of the disclosure.

When injecting fluid 36 through flow control devices 24, the injectivity (ease of injecting fluid) of each segment/zone 32 of the well 28 often is determined largely by the permeability of the formation, the fluid being injected, and the fluid being displaced by the injection process. Given an injection wellbore pressure and a lower far field reservoir pressure, there are two primary sources of pressure loss, specifically losses in the formation/reservoir and losses in the flow control device. As illustrated graphically in FIG. 2, the pressure split between the reservoir/formation 30 and each flow control device 24 varies for a high permeability well zone and a low permeability well zone. In a low permeability well zone, the pressure between the wellbore 26 and the reservoir/formation 30 is primarily lost through the rock of the formation. In a high permeability well zone, the flow rates of injected fluid tend to be much higher and thus a much larger pressure differential occurs across the injection choke of the flow control device 24. The flow control system 20 uses this differential in pressure across the injection choke as a selection mechanism to set the production flow areas/chokes in the individual flow control devices 24. Effectively, the individual flow control devices 24 are constructed to individually adjust a flow area as a function of injection rate resulting from a combined pressure drop through the flow control device 24 and the surrounding formation With respect to the example illustrated in FIG. 2, the high permeability can result from high permeability rock and/or a well zone area saturated with water. The high permeability is associated with a high injectivity. The low permeability can result from low permeability rock and/or a well zone area saturated with high viscosity fluid, and this results in low injectivity. When a well segment/zone 32 has high injectivity, there will be a high flow rate through the corresponding flow control device 24, e.g. through the corresponding injection choke. This high flow rate causes a high differential pressure across the flow control device/injection choke. The high differential pressure across the flow control device/injection choke may be used for selecting the desired production choke setting as a relatively high choke setting. When a well segment/zone has low injectivity, there will be a low flow rate through the corresponding flow control device 24, e.g. through the corresponding injection choke. The low flow rate causes a low differential pressure across the flow control device/injection choke. The low differential pressure may be used for selecting the desired production choke setting as a relatively low choke setting.

A variety of adjustable flow control devices 24 may be used for establishing a desired choke setting. For example, the choke setting may be established by using multiple valve settings or a combination of several binary valves, e.g. choke valves, in the flow control device. A pseudo-analog response technique may be applied for setting the individual flow control devices 24 to various semi-continuous sets of ranges. This allows the individual flow control devices 24 to be set to a desired, e.g. optimal, choke setting for various well zones 32 over a range of values with respect to injectivity.

Figure 3:
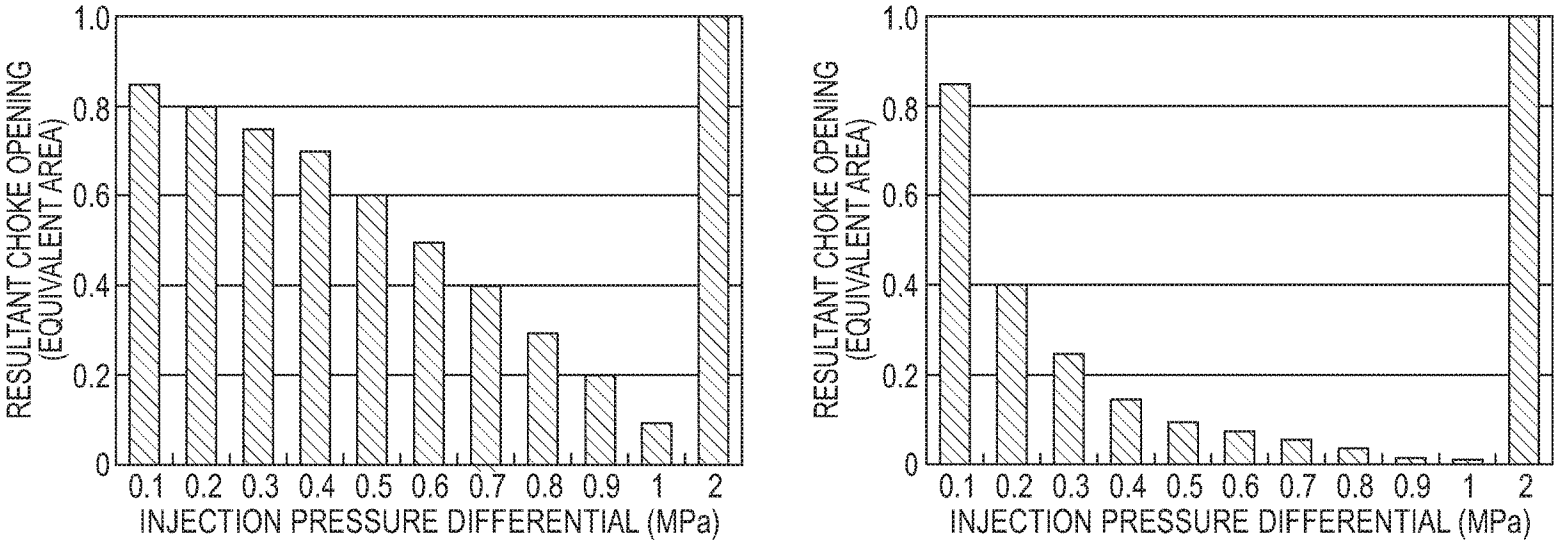
FIG. 3 is a graphical representation of injection pressure differentials versus different resultant choke openings on the flow control devices, according to an embodiment of the disclosure.

FIG. 3 illustrates two graphical examples of responses to measured injection differential pressures and the resulting production choke settings. The responses can be tuned by modifying the sensitivity of the choke mechanisms, e.g. valve closing mechanisms. Additionally, the response may be a single optimal design or may be tuned for the specific parameters of a reservoir or well. In some applications, an over-pressure application may be used to initiate a reset mechanism on the flow control devices 24, e.g flow control device chokes, to set them to a fully open position during an injection stage.

Figure 4:
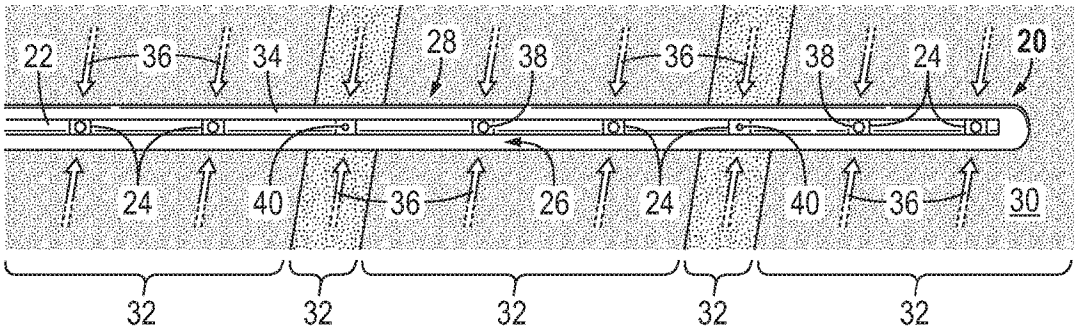
FIG. 4 is a schematic illustration of an example of a well system having different choke openings and deployed in a wellbore extending through a formation having a plurality of well zones with different levels of permeability, according to an embodiment of the disclosure.

During the injection stage, injection fluid is injected into the surrounding well zones 32 through flow control devices 24 and the injectivity of specific well zones 32 is used to set the production flow areas/chokes on specific corresponding flow control devices 24. High injectivity zones 32 often have high permeability and thus the corresponding flow control devices 24 are set to highly choked production settings. On the other hand, the low injectivity zones 32 often have low permeability and thus the corresponding flow control devices 24 are set to weakly choked production settings. Intermediate injectivity results in intermediate choke positions for the corresponding flow control devices 24. By adjusting the choke positions/flow areas of individual flow control devices as a function of the injection flow rate through the individual flow control devices 24, a balanced well inflow profile can be created, as illustrated schematically in FIG. 4. In this figure, flow control devices 24 in low permeability zones 32 are set to have relatively large flow areas 38 (weakly choked) and the flow control devices 24 in high permeability zones 32 are set to have relatively small flow areas 40 (highly choked) to provide the balanced inflow profile.

According to an embodiment, the injection setting process is initially carried out after the well has been adequately cleaned up. However, the process also can be used with appropriate cycling to improve the well cleanup operation and also to improve, e.g. optimize, production from the well 28. However, changes in the reservoir, well, field or production strategy, or other conditions may result in different desired flow settings for a given well 28. The technique described herein enables repetition of the injection process at, for example, regular intervals to determine the different optimal or other desired flow settings for each well zone 32. Shifting the flow control devices 24 to an injection flow and injecting fluids at regular intervals enables adjustment of the flow control device settings so as to better react to well events such as water or gas coning of the well or changes in the relative permeability of the local reservoir/formation 30. The process by which the injection flow (reverse flow) is used to set the chokes of the flow control devices 24 can be repeated throughout the lifetime of a well. This allows the flow areas of the flow control devices 24 to be reset at various stages of the well.

Figure 5:
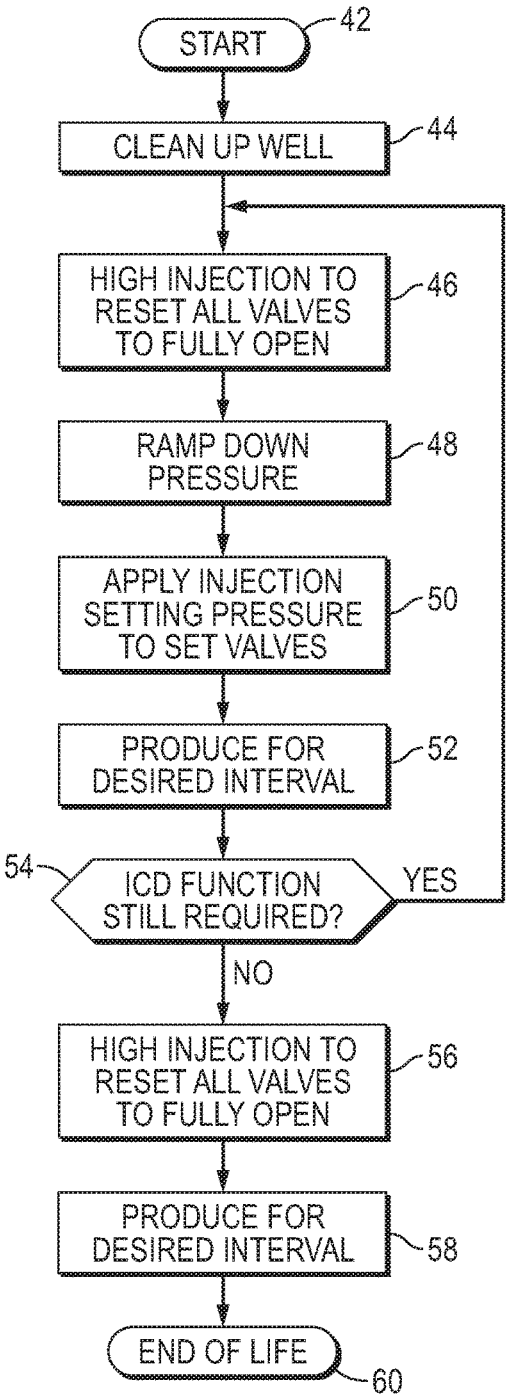
FIG. 5 is a flowchart illustrating an example of a methodology using injection intervals separated by production intervals to set flow areas of flow control devices, according to an embodiment of the disclosure.

Referring generally to FIG. 5, a flowchart is provided to illustrate an example of a procedure for optimizing production through a plurality of adjustable flow control devices. In this example, the well application is initiated, as represented by block 42, and then a well cleanup operation is performed, as represented by block 44. Prior to the injection stage, the flow control devices 24 are set to a fully open flow position by, for example, delivering a high injection flow and thus high pressure flow downhole through the tubing string 22, as represented by block 46. The pressure is then ramped down and an injection fluid is pumped out through the flow control devices 24 and into the corresponding well zones 32, as represented by block 48. The flow areas/choke positions of the flow control devices 24 are then set for production as a function of the injection flow rates through the individual flow control devices 24, as represented by block 50. Once the flow control devices 24 are individually set to provide the desired, balanced well inflow profile (or other desired profile), a production fluid is produced from the surrounding formation 30, as represented by block 52.

As represented by decision block 54, a decision may then be made as to whether the flow control device setting process is still desired. If the well application can benefit from resetting the flow areas of the flow control devices 24, the injection and production cycle may be repeated one or more times. In this application, the flow control devices 24 may be set to a desired position, e.g. a fully open position, when the flow control device setting process is no longer desired, as represented by block 56. Once set to this desired position, the well may be produced for a desired interval, as represented by block 58, until the life of the well is completed, as represented by block 60.

Figure 6:
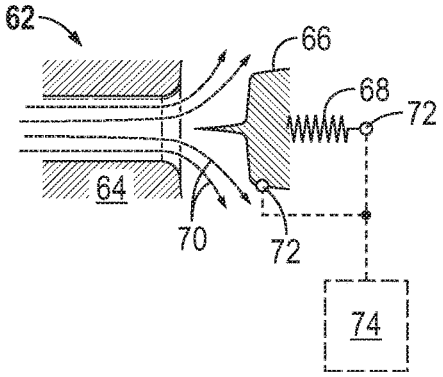
FIG. 6 is a schematic illustration of an example of a check valve type flow control device during injection, according to an embodiment of the disclosure.
Figure 7:
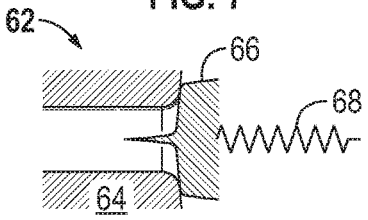
FIG. 7 is a schematic illustration of a check valve type flow control device triggered to a closed position, according to an embodiment of the disclosure.
Figure 8:
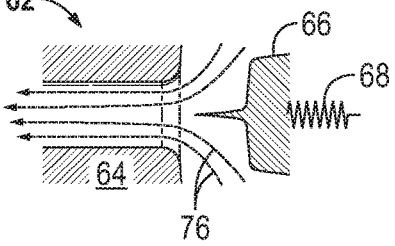
FIG. 8 is a schematic illustration of a check valve type flow control device in an open position during production, according to an embodiment of the disclosure.

The flow control devices 24 may comprise a variety of actuator mechanisms, e.g. chokes, for controlling the flow areas for both injection of fluid and production of fluid. According to an embodiment, the flow control device actuator mechanism may comprise a plurality of trigger activated check valves 62 operated in parallel. An example of one of the check valves 62 is illustrated in FIGS. 6-8. In this example, each trigger activated check valve 62 comprises a nozzle device 64, a checking component 66, and a spring device 68.

FIG. 6 illustrates flow of injection fluid in the injection direction, as represented by arrows 70. During the injection phase, the flow control device 24 remains open to flow. During the injection flow, the pressure differential across the check valve 62 is measured by a sensor 72 which outputs the data to a control system 74, such as a processor-based control system. The control system 74 may be used to automatically determine the production flow area settings for each of the flow control devices 24 as a function of the injection flow rates for each flow control device 24. In some applications, the control system 74 may be used to automatically set each individual flow control device 24 to the desired production flow area setting following the injection phase. A variety of models or algorithms may be used to select production flow area settings as a function of the injection flow rates through the flow control devices 24 when set at the open flow injection settings. Depending on the application, the sensor or sensors 72 may comprise electronic pressure measurement sensors, pressure activated triggers, or other suitable sensors attached to appropriate components of the flow control device 24.

In another embodiment, the sensor 72 may be combined with control system 74 in a mechanical, spring-loaded J-slot mechanism. If differential pressure is sufficient to reach a trigger level, the J-slot mechanism is constructed to move back to an initial position independent of the previous position. In a simplified embodiment, the valve/flow control device 24 may be constructed without the reset function. In this latter embodiment, a shear mechanism or snap mechanism may be used to shift the valve positions when a predetermined differential trigger pressure is achieved. In these types of embodiments, the valve/flow control device 24 is open to flow in an injection mode but is transitioned to an open or closed position in production mode depending on the differential pressure reached during the injection mode.

Each of the check valves 62 may be actuated via applied pressure between an activated configuration and an inactivated configuration. If the activation pressure for a given check valve 62 is exceeded during flow of injection fluid, then that specific check valve 62 becomes activated (triggered). However, if the activation pressure for a given check valve 62 is not exceeded, then that specific check valve 62 remains inactivated (not triggered). When the well is placed into production, each flow control device 14 will have a select number of check valves 62 that have been triggered or remain not triggered. The triggered check valves 62 check or block production flow, as illustrated in FIG. 7. However, the check valves which have not been triggered allow flow of production fluid, as represented by arrows 76 in FIG. 8. The triggering device may comprise a variety of latches, catches, or other features which hold or release the checking component 66 in response to application of predetermined pressure levels or other suitable inputs.

The check valves 62 remain in their triggered/checked or non-triggered configurations while production flow is maintained. However, if the injection stage is repeated, the checked or triggered check valves 62 are again opened to accommodate injection flow 70 by, for example, applying a high pressure down through the tubing string 22 or by another suitable input. Based on flow rates during the injection stage, the check valves 62 of each flow control device 24 may then be reset to accommodate a desired production flow along the tubing string 22.

Figure 9:
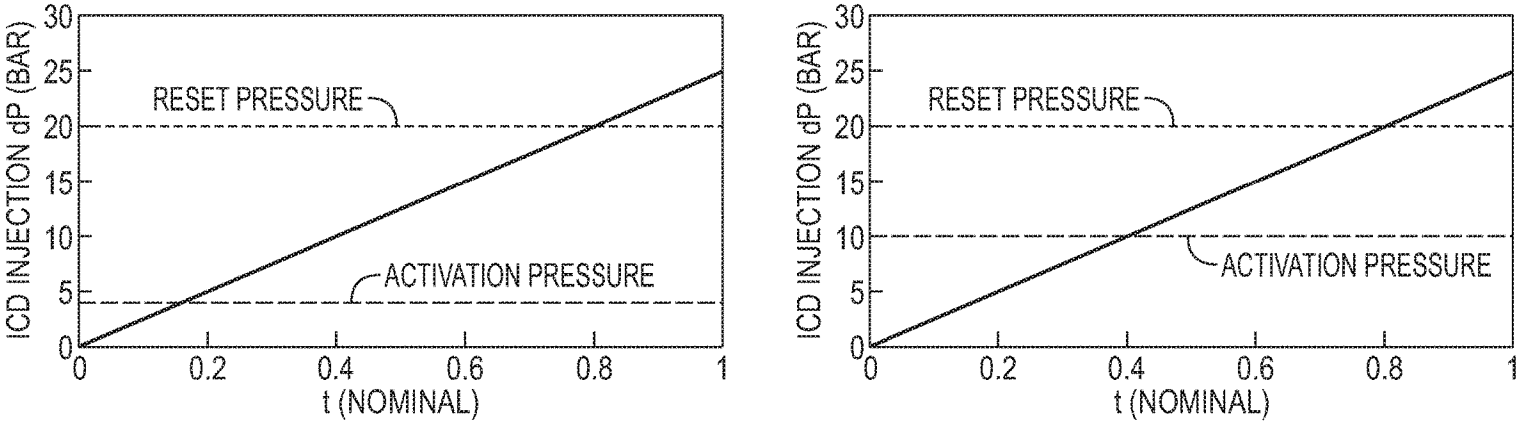
FIG. 9 is a graphical representation of different activation pressures for resetting and triggering certain types of flow control devices, according to an embodiment of the disclosure.

In this example, each check valve 62 has a check trigger pressure threshold and a reset trigger pressure threshold. A plurality of the check valves 62 for each flow control device 24 may have unique trigger pressure thresholds and thus the individual flow control devices 24 can self-tune to a desired setting based on the pressure differential applied during the injection phase. In FIG. 9, for example, a potential pressure-activation profile is illustrated for separate check valves 62 (or other pressure activated flow control devices). In the specific example illustrated, a first check valve 62 has a 4 bar trigger pressure (left graph) while a second check valve 62 has a 10 bar trigger pressure (right graph). Both of the check valves 62 may be reset to an injection position, e.g. open flow position, by applying an injection pressure of 20 bar. However, additional and/or other pressure values may be used for triggering and/or resetting the check valves 62 (or other types of flow control mechanisms).

Figure 10:
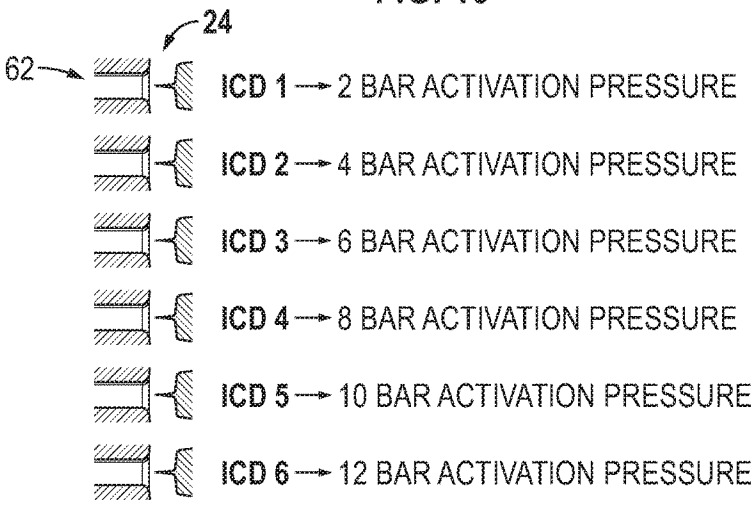
FIG. 10 is a schematic illustration of a flow control device utilizing a plurality of valves operating in parallel, according to an embodiment of the disclosure.

In an operational example illustrated in FIG. 10, each flow control device 24 comprises a plurality of check nozzles/valves 62, e.g. six check valves 62, operating in parallel and each of the check valves 62 has a different activation/trigger pressure. In this example, the six check valves 62 are located on a single screen joint and function as an individual flow control device 24. Again, different numbers of check valves 62 (or other flow control devices) may be used in constructing each flow control device 24.

Figure 11:
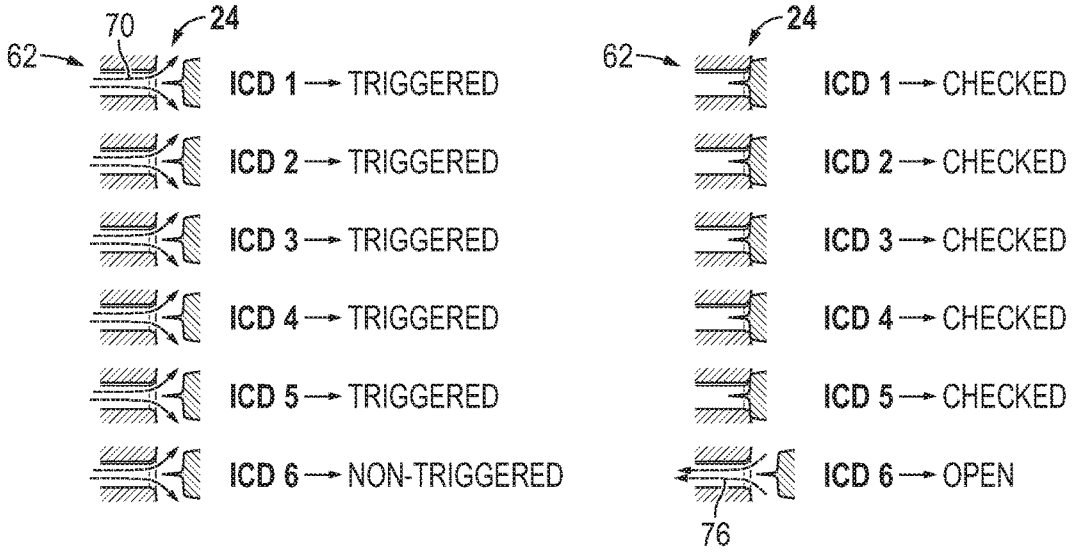
FIG. 11 is a schematic illustration of a flow control device utilizing a plurality of valves operating in parallel to provide different configurations of open and closed valves having different collective flow areas, according to an embodiment of the disclosure.

As illustrated in FIG. 11, an 11 bar injection pressure has occurred through a given flow control device 24 which is representative of injection into a high permeability well zone 32 of formation/reservoir 30. In this example, five of the six check valves 62 have been triggered by the 11 bar pressurized flow of injection fluid 70, as illustrated on the right side of FIG. 11. When the tubing string 22 is placed into a production mode, five of the check valves 62 remain checked and one of the check valves 62 remains open to admit production flow 76 therethrough. The single open check valve 62 provides a limited flow area for inflow of production fluid from a highly permeable well zone 32. In this manner, the individual flow control devices 24 may be automatically set during the injection stage to achieve the desired flow area during the production stage.

Figure 12:
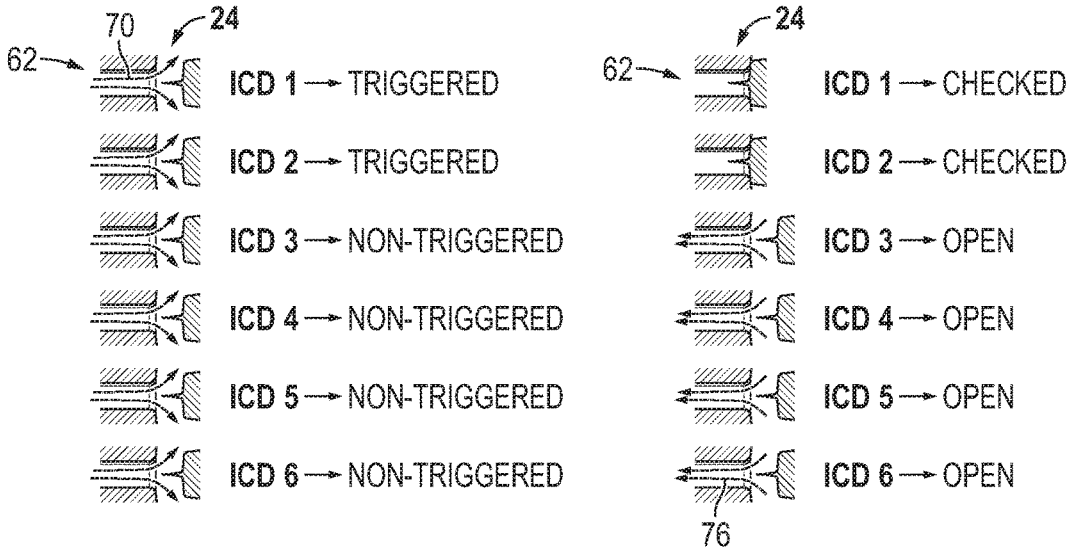
FIG. 12 is another schematic illustration of a flow control device utilizing a plurality of valves operating in parallel to provide different configurations of open and closed valves having different collective flow areas, according to an embodiment of the disclosure.

Another operational example is illustrated in FIG. 12. In this example, a 5 bar injection pressure has occurred through a given flow control device 24 which is representative of injection into a moderately less permeable well zone 32 of formation/reservoir 30. In this example, two of the six check valves 62 have been triggered by the 5 bar pressurized flow of injection fluid 70, as illustrated on the right side of FIG. 12. When the tubing string 22 is placed into a production mode, two of the check valves 62 remain checked and four of the check valves 62 remain open to admit production flow 76 therethrough. The four open check valves 62 provide a moderate flow area for inflow of production fluid from a moderately permeable well zone 32. In this manner, the individual flow control devices 24 are again automatically set during the injection stage to achieve the desired flow area during the production stage.

Figure 13:
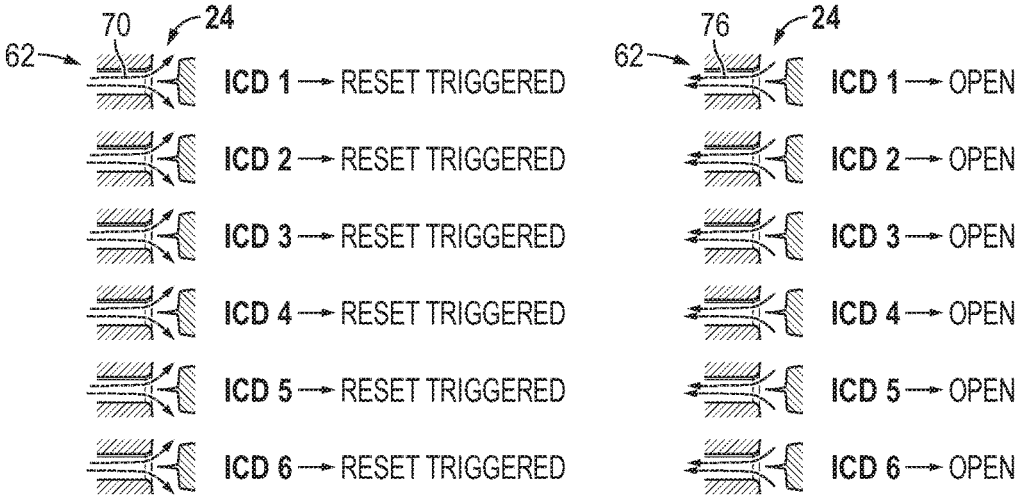
FIG. 13 is another schematic illustration of a flow control device utilizing a plurality of valves operating in parallel to provide different configurations of open and closed valves having different collective flow areas, according to an embodiment of the disclosure.

Another operational example is illustrated in FIG. 13. In this example, a 20 bar injection pressure has occurred through a given flow control device 24 which is representative of injection into a low permeability well zone 32 of formation/reservoir 30. In this example, six of the six check valves 62 have been triggered by the 20 bar pressurized flow of injection fluid 70, as illustrated on the right side of FIG. 13. When the tubing string 22 is placed into a production mode, not one of the check valves 62 remains checked and each of the six of the check valves 62 remains open to admit production flow 76 therethrough. The six open check valves 62 provide a large flow area for inflow of production fluid from a low permeability well zone 32. In this manner, the individual flow control devices 24 are again automatically set during the injection stage to achieve the desired flow area during the production stage. It should be noted that a high applied pressure, e.g. 20 bar pressure, can be used to reset the check valves 62 to an open position prior to initiation of another injection stage.

The methodology for using flow control system 20 is useful in a variety of different embodiments and applications. For example, the reset and trigger logic described above is compatible with the use of a substantially high injection pressure to reset the flow control devices 24, e.g to reset the flow control devices to an open flow position for injection. The flow control devices, e.g. check valves 62, may have a variety of configurations for sensing pressure differentials or flow rates and for actuating triggers and reset mechanisms. For example, the triggers and reset mechanisms may be mechanical, electrical, hydraulic, and/or other suitable types of mechanisms.

The flow control devices 24 discussed above comprise embodiments in which multiple valves, e.g. multiple check valves 62, are used in parallel. However, other embodiments may utilize single valves having multiple choke settings, as discussed in greater detail below. In some embodiments, the methodology and structure of flow control system 20 enables flow control devices 24 to be placed at a variety of locations along the tubing string 22 because setting of the flow control devices 24 is carried out downhole. In some applications, the flow control devices 24 of flow control system 20 may be optimized or otherwise tailored for specific well characteristics, such as reservoir fluid types and permeability contrasts. Specific tailoring may involve setting the activation threshold for each of the flow control devices 24, e.g. setting the activation threshold for the check valves 62 of each flow control device 24.

In some embodiments, the flow control system 20 and the method of injecting and then adjusting the flow area of individual flow control devices as a function of the injection flow rates may be used in other applications, including well cleanup applications and to facilitate improved utilization of the full length of the completion/tubing string 22. A cycle of inject/produce/inject/produce/inject and so on may be used to sequentially close the cleaned heel compartments of the wellbore 26, thus allowing improved cleanup of the next sequential well compartments. By way of example, the cleanup may involve removing mud cake from the wellbore. The flow control system 20 and the methodology described herein also facilitate selection of improved, e.g. optimized, production settings for the flow control devices 24. The production settings may be selected (and subsequently readjusted if desired) at a given time as a function of the injection flow rates. By way of example, the function enabling selection of the desired production settings may be based on an inverse of the injectivity profile measured along the tubing string 22 during the injection stage.

Figure 14:
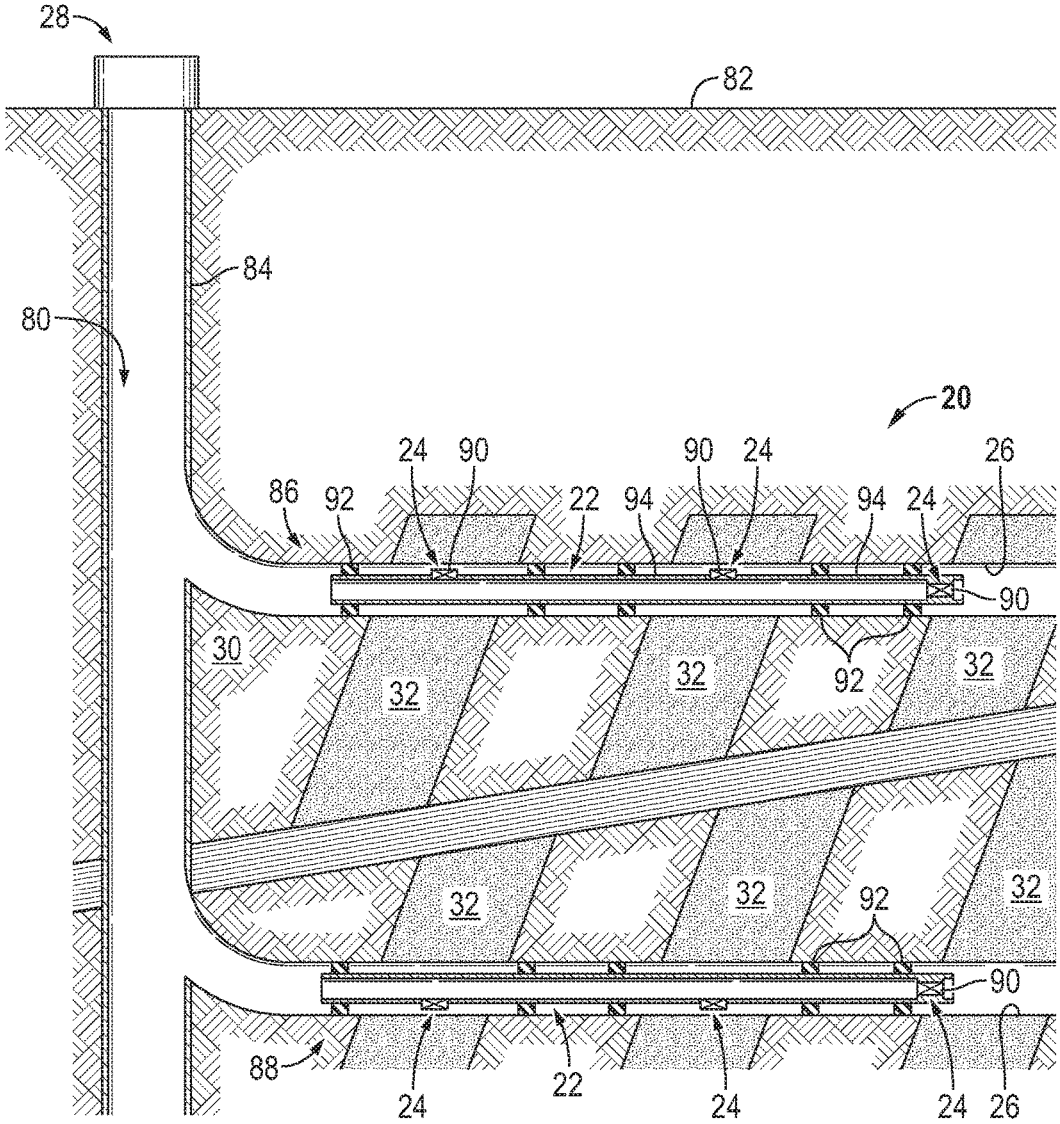
FIG. 14 is a schematic cross-sectional illustration of an example of a well system having a plurality of flow control devices, according to an embodiment of the disclosure.

Referring generally to FIG. 14, another example of flow control system 20 is illustrated. In this example, flow control system 20 is illustrated schematically in cross-section as deployed in well 28 having a main bore 80 extending below a surface 82 which may be a terrestrial or subsea surface. The main bore 80 may have portions lined with a casing 84, and lateral wellbore branches 86 and 88 may extend from the main bore 80. In this example, wellbore branches 86 and 88 are deviated, e.g. horizontal, and extend through well zones 32 of formation 30. Although multiple well zones 32 and multiple branches 86, 88 are illustrated, other embodiments may comprise single or additional well zones and/or wellbore branches. Depending on the application, embodiments of the system and methodology may be used with single or multiple well zones, single or multiple tubing strings, deviated or non-deviated wellbores, and with various combinations of components, wellbores and/or flow control systems. The configurations also may vary between different branches of the well 28.

In the interest of simplification, lateral wellbore branch 86 may be used as an example and described in greater detail. However, the system and methodology described with respect to lateral wellbore branch 86 may be applied in single and multiple wellbore systems. Within lateral branch 86, active, in-situ flow control devices 24 are provided proximate corresponding well zones 32 of formation 30. The flow control devices 24 may be individually set as a function of injection flow rates to provide an improved control over inflow of production fluid from the well zones 32 as described above.

In this example, three flow control devices 24 are illustrated, but a greater or lesser number of flow control devices 24 may be used depending on the parameters of a given application. Additionally, the flow control devices 24 may be the same as each other or they may be different in terms of configuration and function. In this example, each flow control device 24 comprises a controllable valve 90 that may be adjusted to a desired flow setting based on the flow results measured during the injection stage. In some applications, each flow control device 24 also may comprise a nozzle type ICD or other type of ICD through which production fluid flows from the corresponding well zone 32, into annulus 34, and ultimately into the interior of tubing string 22 for production to surface 82.

Additionally, at least one packer 92 and often a plurality of packers 92 may be used to isolate well zones 32 by sectioning off portions of annulus 34 along lateral wellbore branch 86. It should be noted that lateral wellbore branch 86 is illustrated in an open hole configuration, but the lateral branch 86 may be lined or cased. Additionally, the lateral branch 86 (and other lateral branches) may be perforated, gravel packed, and/or provided with sand screens, e.g. expandable sand screens, depending on the parameters of a particular well application. In the example illustrated, packers 92 function to divide the lateral wellbore branch 86 into various sections corresponding with well zones 32. Packers 92 may be used with various embodiments of the flow control devices 24 described herein.

In the present example, controllable valves 90 of corresponding flow control devices 24 may be operated to adjust the inflow of fluid from each corresponding well zone 32 depending on the conditions in the lateral branch 86. For example, individual valves 90 of corresponding flow control devices 24 may be adjusted to balance inflow of production fluid along the tubing string 22 and across the well zones 32 based on the injection flow profile determined as described above. By way of example, the balanced inflow of production fluid may be used to control water cut or to otherwise optimize production from well 28. The flow control devices 24 and corresponding valves 90 may be placed at a variety of locations along the wellbore. In the illustrated example, however, two of the flow control devices 24 have valves 90 positioned to control inflow of fluid through a circumference of the tubing string 22 while the third flow control device 24 has its valve 90 positioned to control inflow of fluid through an end of the tubing string 22. The flow control devices 24 may be coupled together along the tubing string 22 by a variety of pipe sections 94. The pipe sections 94 may comprise casing or other types of tubing which may be coupled with the flow control devices 24.

Figure 15:
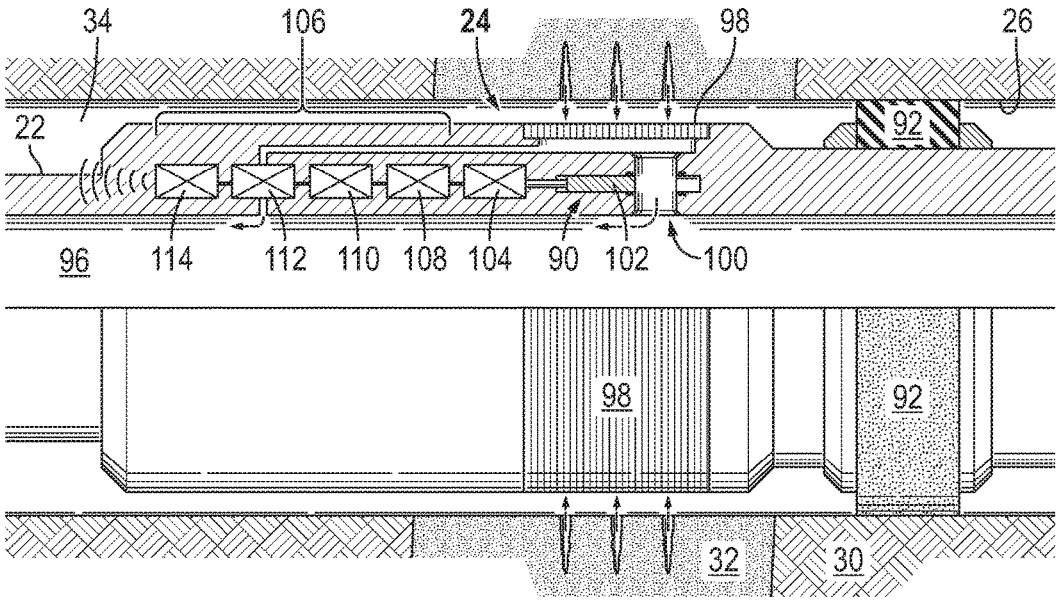
FIG. 15 is a schematic, partial cross-sectional illustration of another example of a flow control device, according to an embodiment of the disclosure.

Referring generally to FIG. 15, another example of one of the flow control devices 24 is illustrated. In this embodiment, the flow control device 24 is located proximate one of the packers 92, such as a swellable packer, a mechanically set packer, or a hydraulically set packer, positioned to seal off a segment of the wellbore 26 proximate a given well zone 32. However, the flow control device 24 may be positioned at a variety of locations along the tubing string 22. The corresponding well zone 32 may contain a desirable fluid which flows into the wellbore annulus 34 surrounding tubing string 22. The fluid then moves inwardly through flow control device 24 and into an interior 96 of tubing string 22. In some embodiments, the fluid flowing to interior 96 through flow control device 24 flows through a sand screen 98.

In the illustrated example, the flow control device 24 comprises valve 90 which is in the form of a single adjustable valve that may be operated to adjust the choking of fluid flow through the flow control device 24 by changing the flow area of a passage 100. By way of example, valve 90 may comprise a choke in the form of a sliding sleeve 102 although other types of controllable mechanisms may be used to adjust the level of choking with respect to the fluid flow through flow control device 24. The valve 90 may be operated between a fully open position and a fully closed position and also may be set to variable choke positions between the fully open and fully closed positions. In this manner, the single valve 90 may be selectively adjusted to control the flow rate of fluid flowing between the exterior and interior of the flow control device 24.

As illustrated in FIG. 15, valve 90 may comprise or be coupled with an actuator 104 which may be operated by various types of actuation system/techniques, including electric, hydraulic, electro-hydraulic, electro-mechanical, mechanical, and/or other types of actuation systems and techniques. The actuator 104 may be coupled with other components 106, such as sensors 108, a control module 110, an energy storage and/or conversion module 112, a telemetry module 114, and/or other suitable components. In this example, the telemetry module 114 may be communicatively coupled to the surface via various telemetry systems, such as hydraulic, electric, or optical which may use wireless communication or various types of cables or control lines. Depending on the application, the communicative coupling or portions of the communicative coupling may be wireless and may comprise devices such as inductive couplings, receiver/transmitter systems, pressure or acoustic systems, or combinations of various forms of wireless coupling.

The telemetry module 114 may be used with this embodiment and other embodiments described herein to communicate signals to, for example, control system 74. Control system 74 may be located at the surface or at another suitable location for processing injection flow rate data to determine the flow control device settings for each well zone 32 as a function of the injection flow rates, as described above. Additionally, various other communications may be transmitted uphole from flow control device 24 and/or downhole to flow control device 24. Such communications may include information signals, e.g. data and/or command signals, power or energy signals, or combinations of signals.

Figure 16:
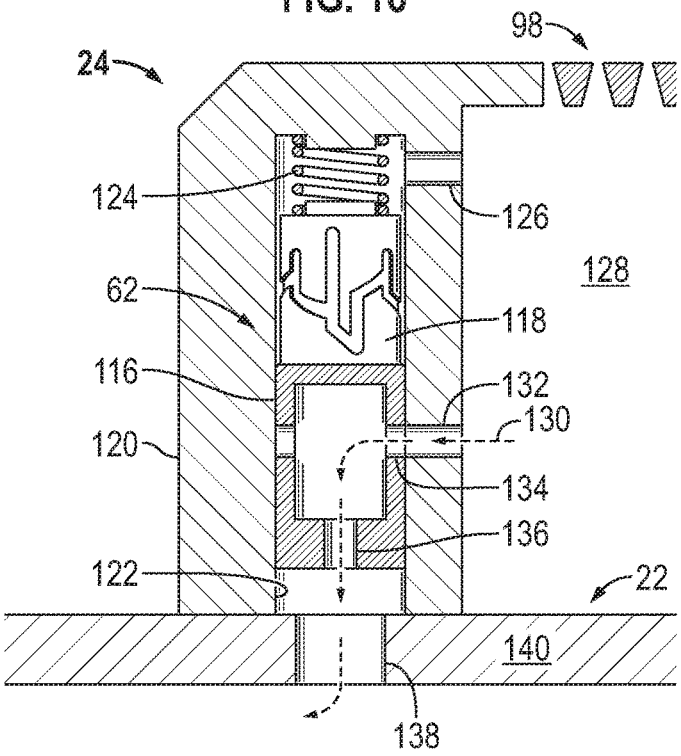
FIG. 16 is a schematic cross-sectional illustration of another example of a flow control device, according to an embodiment of the disclosure.
Figure 17:
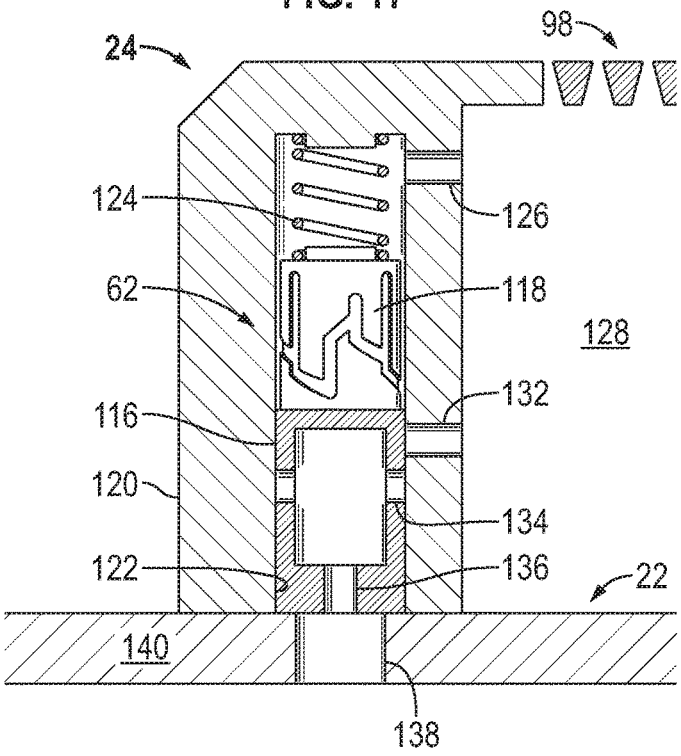
FIG. 17 is a schematic cross-sectional illustration similar to that of FIG. 16 but showing the flow control device in a different operational configuration, according to an embodiment of the disclosure.
Figure 18:
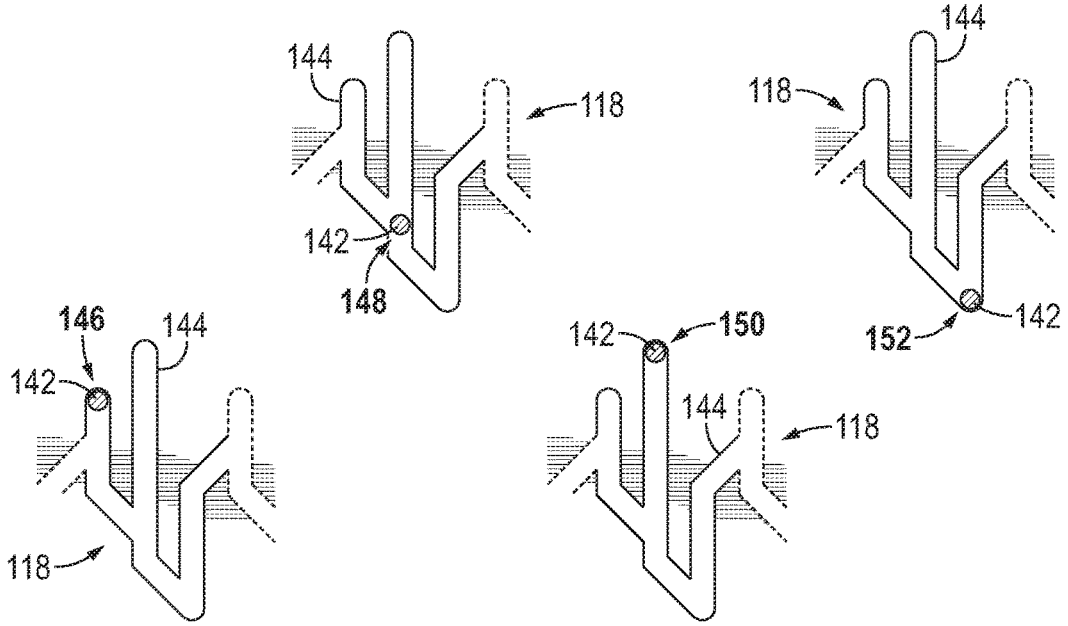
FIG. 18 is a schematic representation of an example of a J-slot mechanism which may be used to control actuation of the flow control device, according to an embodiment of the disclosure.

Referring generally to FIGS. 16-18, another embodiment of flow control device 24 is illustrated. In this embodiment, the flow control device 24 comprises valve 62 in the form of a shuttle valve 116 coupled to a J-slot mechanism 118. The shuttle valve 116 cooperates with sand screen 98 and has a valve housing 120 defining a cavity 122. The shuttle valve 116 can reciprocate, e.g. move up and down, within cavity 122, and the position of the shuttle valve 116 is controlled by the J-slot mechanism 118 in combination with a spring 124. A ventilation port 126 communicates between cavity 122 proximate spring 124 and with an exterior cavity 128 which is in communication with a reservoir or formation side of the flow control valve 62.

In FIG. 16, the shuttle valve 116 is in a normal open mode which allows fluid to flow from the surrounding reservoir, through the sand screen 98, into exterior cavity 128, and into cavity 122, as indicated by flow line 130. As further indicated, the flow of fluid moves along flow line 130 through a port 132 in valve housing 120 and then to an interior of the shuttle valve 116 through a port 134. From the interior of shuttle valve 116, the fluid moves out through a nozzle 136 of shuttle valve 116 and then through a port or passage 138 of a base pipe 140 of tubing string 22.

While in the injection mode, fluid flows in an opposite direction to that illustrated by flow line 130. During the injection mode, the differential pressure across nozzle 136 compresses spring 124. If the pressure across nozzle 136 is sufficient, the spring 124 is increasingly compressed and causes a corresponding traveling distance of the J-slot mechanism 118. When the injection of fluid is stopped, the J-slot mechanism 118 is returned to a position which is a function of the applied pressure.

In FIG. 17, the shuttle valve 116 is illustrated in a closed position. Due to the axial movement of the shuttle valve 116, the two ports 134 and 132 are no longer aligned and the inflow of reservoir fluid through the shuttle valve 116 is restricted or blocked. During the injection stage, pressure acts on the shuttle valve 116 through the port/passage 138, and the other side of the shuttle valve 116 is ventilated through port 126. This causes the shuttle valve 116 to be reopened. When the injection of fluid is again stopped, the shuttle valve 116 is returned to a position which is a function of the applied pressure.

Referring generally to FIG. 18, an example of J-slot mechanism 118 is illustrated in different operational positions. In this example, the J-slot mechanism 118 comprises a guide pin 142 which is guided along a slot or groove 144. As illustrated, the guide pin 142 is positioned at an initial position 146. When injection pressure is applied, the J-slot mechanism 118 is shifted to a new position determined by the differential pressure acting on shuttle valve 116 and on spring 124. If the injection pressure is sufficient to move the guide pin 142 to a new position 148, the guide pin 142 is then automatically moved via spring 124 and groove 144 to a subsequent new position 150 when the injection of fluid is stopped. This corresponds to the shuttle valve 116 being moved to its closed position illustrated in FIG. 17. If the injection pressure is applied again to a sufficiently high level (or was applied initially to the sufficiently high level), the guide pin 142 moves directly to a reset position 152. This allows the guide pin 142 to automatically return to the initial position 146 when the injection of fluid is stopped.

FIG. 18 shows guide pin 142 in various positions 146, 148, 150 and 152 which are illustrated in a two dimensional view. In practice, however, the J-slot mechanism 118 may be constructed as a cylinder so that the pattern repeats as indicated by the dashed lines in FIG. 18. This allows the injection process to be repeated multiple times. It should be noted that in the illustrated embodiment, the ports 134 and 132 are aligned and allow flow during the various illustrated positions of J-slot mechanism 118 except when the guide pin 142 is at position 150.

Additionally, the illustrated sequence of positions may be used with certain valve configurations. In other embodiments, however, the J-slot mechanism 118 may be different and the valve 62 may have an initial closed position. When a high, reset injection pressure is applied, the valve 62 can go back to this closed position. In another embodiment, the valve 62 can be constructed to close as injection pressure exceeds a high, reset pressure. This type of functionality can be useful for activating other tools in the completion string via high pressure.

In another embodiment, the port 132 may comprise a relatively small nozzle and a check valve. The check valve is configured so that it is in a fully open position when in production mode and is closed when in injection mode. In the injection mode, the injection fluid is diverted into the relatively small nozzle which enables creation of sufficient differential pressure to shift the shuttle valve 116 without having to apply a high flow rate. This type of embodiment also enables greater flexibility with respect to tuning the injection pressure drop and inflow pressure drop through the flow control device 24 as compared to embodiments using reservoir pressure drop.

The flow control system 20 may be used in a variety of applications, including numerous types of well production applications. Depending on the specifics of a given well application and environment, the construction of the overall system 20, tubing string 22, flow control devices 24, and/or control system 74 may vary. Additionally, the system may be designed for use in many types of wells, including vertical wells and deviated, e.g. horizontal, wells. The wells may be drilled in a variety of formations with single or multiple production zones and with many types of gravel packs. Accordingly, single or multiple flow control devices 24 may be used in a given flow control system 20 depending on the design of the well and the number of well zones.

Depending on the application, many types of flow control devices 24 also may be employed in the overall system 20. For example, some flow control devices 24 may comprise a plurality of parallel valves, e.g. check valves 62, used to set the desired level of choking and thus the flow area through the flow control device 24. Other flow control devices 24 may use a single adjustable valve, e.g. controllable valve 90, to set the desired flow area through the flow control device 24. Additionally, many types of sensors and control systems may be used to collect flow rate data and other types of data during the injection stage. This data may be sent to the surface for processing, and then control signals may be used to set the flow control devices at their desired choke positions for production. However, some flow control devices 24 may be set automatically at their downhole location without sending signals to the surface, e.g. set according to the pressure level applied during injection. In this sense, the control system may be a fully automated downhole control system. The tubing string 22 also may incorporate a variety of other types of components which work in cooperation with the flow control devices 24.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A method for use in a well, comprising:

providing a tubing string with a plurality of flow control devices;

conveying the tubing string downhole into a wellbore;

pumping an injection fluid along an interior of the tubing string, out through the plurality of flow control devices, and into a surrounding formation;

adjusting the flow areas of individual flow control devices of the plurality of flow control devices as a function of an injection flow rates through the individual flow control devices during pumping of the injection fluid; and producing a production fluid from the surrounding formation through the flow control devices after adjusting the flow areas of the individual flow control devices.

2. The method as recited in claim 1, wherein providing comprises providing each flow control device with a variable choke.

3. The method as recited in claim 1, wherein providing comprises providing each flow control device with a variable valve operated via a sliding sleeve.

4. The method as recited in claim 1, wherein providing comprises providing each flow control device with a plurality of valves that may be individually triggered between an open flow position and a closed flow position for producing the production fluid.

5. The method as recited in claim 1, wherein providing comprises providing each flow control device with a plurality of check valves that may be individually triggered between an open flow position and a closed flow position for producing the production fluid.

6. The method as recited in claim 1, wherein conveying comprises conveying the tubing string into a deviated wellbore.

7. The method as recited in claim 1, further comprising placing a sand screen along an exterior of each flow control device.

8. The method as recited in claim 1, wherein adjusting comprises changing the flow area through each flow control device via a single valve in the flow control device.

9. The method as recited in claim 1, wherein adjusting comprises changing the flow area by closing specific valves of a plurality of valves in each flow control device.

10. The method as recited in claim 1, further comprising repeating the pumping of injection fluid following flow of the production fluid; and readjusting the flow areas of the individual flow control devices.

11. The method as recited in claim 1, wherein providing comprises constructing each flow control device to individually adjust a flow area as a function of injection rate resulting from a combined pressure drop through the flow control device and the surrounding formation.

12. A system for controlling flow in a well, comprising:

a tubing string having a plurality of flow control devices to control flow between an interior and an exterior of the tubing string, the plurality of flow control devices being positioned to reside adjacent corresponding well zones when the tubing string is conveyed downhole into a wellbore, each flow control device of the plurality of flow control devices being individually configurable to a production restriction position as a function of an injection flow rate measured prior to production of a well fluid; and a control system which uses the injection flow rates of the individual flow control devices to determine the production restriction position of each flow control device.

13. The system as recited in claim 12, wherein each flow control device is positioned within a sand screen.

14. The system as recited in claim 12, wherein each flow control device comprises a plurality of check valves separately triggered between an open and a closed position for production of the well fluid.

15. The system as recited in claim 12, wherein each flow control device comprises a valve controllable to adjust a flow area through the valve.

16. A method, comprising:

establishing a flow control system with a plurality of flow control devices along a tubing string;

conveying the tubing string downhole into a wellbore adjacent production zones;

injecting fluid through the plurality of flow control devices and into the production zones while the flow control devices are set at an injection setting;

adjusting the flow area of each of the plurality of flow control devices to a production setting based on the injection flow rates through the plurality of flow control devices; and producing a well fluid from the production zones through the plurality of flow control devices.

17. The method as recited in claim 16, further comprising resetting the plurality of flow control devices to the injection setting; subsequently injecting fluid through the plurality of flow control devices and into the production zones while the flow control devices are set at the injection setting; and readjusting the production setting of each flow control device based on the immediately preceding injection flow rates.

18. The method as recited in claim 16, wherein adjusting the flow area comprises maintaining a predetermined number of check valves in each flow control device in an open position during production of the well fluid.

19. The method as recited in claim 16, wherein adjusting the flow area comprises adjusting an adjustable valve of each flow control device.

20. The method as recited in claim 16, further comprising repeating a cycle of injecting and producing to repeatedly adjust the flow areas of the flow control devices to optimize well cleanup.

21. The method as recited in claim 16, further comprising repeating a cycle of injecting and producing to repeatedly adjust the flow areas of the flow control devices to optimize well production from the production zones.

22. The method of claim 16, further comprising forming at least one of the flow control devices with a shuttle valve.

23. The method of claim 22, further comprising employing a check valve and a nozzle in the shuttle valve to lower a flow rate for shifting the shuttle valve when injecting fluid.

* * * * *